US005361657A

United States Patent [19]

Terry

[11] Patent Number: 5,361,657

[45] Date of Patent: Nov. 8, 1994

[54] DRIVE SOCKET

[76] Inventor: Elliott P. Terry, Rte. 7, Box 192, Danville, Va. 24540

[21] Appl. No.: 59,504

[22] Filed: May 10, 1993

Related U.S. Application Data

[63] Continuation of Ser. No. 745,322, Aug. 15, 1991, abandoned.

[51] Int. Cl.[5] ..... B25B 13/06

[52] U.S. Cl. ..... 81/186; 81/124.6

[58] Field of Search ..... 81/119, 120, 121.1, 81/122, 124.2, 124.3, 124.6, 124.7, 186, 3.4

[56] References Cited

U.S. PATENT DOCUMENTS

| | | | |
|---|---|---|---|
| 1,321,776 | 11/1919 | Stepanian | 81/124.2 |
| 1,590,200 | 6/1926 | McGuckin . | |
| 2,374,192 | 4/1945 | Godfrey | 81/186 |
| 2,517,366 | 8/1950 | Wilson | 81/186 |
| 2,609,720 | 9/1952 | Barnard | 81/186 |
| 3,247,742 | 4/1966 | Woodbury | 81/186 |
| 3,466,956 | 9/1969 | Bowers . | |
| 3,495,485 | 2/1970 | Knudsen et al. . | |
| 3,675,516 | 7/1972 | Knudsen et al. | 81/121.1 |
| 4,126,063 | 11/1978 | Palmer | 81/121.1 |

*Primary Examiner*—D. S. Meislin

*Attorney, Agent, or Firm*—Gilliam & Stockwell

[57] ABSTRACT

A drive socket for imparting torque loads to a fastener element includes a body with a cavity opening to a distal end for receiving the fastener element. The cavity has protuberances projecting inwardly toward the central axis from the cavity surface to engage the fastener element. The protuberances have a frusto-pyramidal shape and are uniformly spaced circumferentially around and longitudinally along the cavity surface. The protuberances thus form a cross-hatched or knurled pattern. The cavity is tapered to further assist in fastener engagement. The protuberances firmly engage the fastener element at longitudinally intermittent points to apply torque loads and facilitate rotary displacement.

16 Claims, 1 Drawing Sheet

DRIVE SOCKET

This is a continuation of application Ser. No. 07/745,322, filed Aug. 15, 1991, now abandoned.

TECHNICAL FIELD

The present invention relates generally to drive sockets for fastener elements, and more particularly, to a drive socket having a cross-hatched or knurled inner surface of the socket cavity for improved engagement with the fastener element.

BACKGROUND OF THE INVENTION

Many mechanical assemblies are comprised of a plurality of components that are coupled together to form a unit. Thus, there are a great many applications for fastening elements such as nuts and bolts that are used to couple components together. It can also be appreciated that the security of the component coupling is often vital to the effective operation of the mechanical assembly. Accordingly, the fastener elements are required to be secured very tightly to hold the components in place.

Drive sockets are widely used to manipulate fastener elements such as nuts and bolts. One common socket design includes a cylindrical body with a receiving cavity whose inner surface is formed to engage the planar faces of the fastener element. For example, most nuts and bolts have a hexagonal configuration. Accordingly, the socket cavity is hexagonally broached to receive with exact registry the hexagonally shaped element. The drive socket thus makes driving contact with the planar faces or flats of the fastener element. This design is generally sufficient to apply torque turning loads to fastener elements for rotary displacement in most operative environments.

U.S. Pat. Nos. 3,675,516 and 3,495,485, both to Knudsen et al., disclose drive sockets with splined cavities to accommodate polygonally shaped fastener elements. The particular cavity surface design allows confronting surface engagement with the flats of the element adjacent the corners. When applying torque loads to the element, there is substantially no stripping of the corners of the fastener element.

While generally effective for their operative purpose, these socket drives are not without their shortcomings. More specifically, they do not efficiently accommodate fastener elements of all configurations. In particular, rounded fastener elements do not have flats for cooperative engagement with the operative faces of socket splines.

In addition, frequently a nut forms so tight a union to a bolt or threaded lug that the torque requirement for rotary displacement cannot be effectively applied by these drive sockets. A classic example of this situation involves the lug nuts on the wheel of an automobile. In attempting to break a lug nut "free" from its adhesive-like union, the splines of the socket cavity often slip along the flats of the lug nut and across the corners. This eventually leads to the rounding of the corners, also known as the stripping of the lug nut. Once a lug nut is stripped, a standard drive socket cannot be used to accomplish removal. In fact, it is possible for a lug nut to become so damaged that it may only be removed by cutting the threaded wheel lug on which it is fastened. This is both costly and inconvenient. Typically, a professional mechanic must be employed to replace the lug after cutting.

U.S. Pat. No. 1,590,200 to McGuckin discloses a design that is helpful in addressing the problem of applying high torque forces to a fastening element without slipping across the corners of that element. The drive socket has a tapered cavity to assist in the firm engagement of the fastener element. Furthermore, a substantially longitudinally directed, spiral spline configuration is provided to bite into the surface of the fastener element.

The McGuckin design, however, also presents certain problems. More particularly, the spiral splines only allow a high torque load to be effectively applied in one rotary direction. For example, a spiral spline configuration with a clockwise twist or pitch serves to draw the socket down on the fastening element for secure engagement in the narrower portion of the tapered socket when tightening the fastening element. Conversely, when attempting to loosen the fastening element, such a clockwise spiral spline configuration serves to draw the socket upwardly on the fastening element which is then in registration with the wide portion of the taper. This results in a loss of "grip" that directly leads to slipping and the stripping of the fastening element. Accordingly, the McGuckin drive socket is not adapted to both securely tighten a fastener element and remove an element that is very tightly attached.

Accordingly, a need is identified to provide a drive socket that overcomes the disadvantages of the above-described designs. Such a drive socket would be particularly effective in both securely tightening and removing fastener elements from adhesive-like engagement. The drive socket would be adapted to cooperate with commonly known drive elements such as ratchets or air wrenches.

SUMMARY OF THE INVENTION

Accordingly, it is a primary object of the present invention to provide a drive socket overcoming the above-described limitations and disadvantages of the prior art.

An additional object of the present invention is to provide a drive socket that is particularly adapted to securely fasten and also remove tightly attached fastener elements.

It is another object of the present invention to provide a drive socket that firmly engages a fastener element to efficiently transmit high torque load for rotary displacement without slipping and thereby stripping the fastener element.

It is a further object of the present invention to provide a drive socket with protuberances disposed on an inwardly tapered cavity to assist in providing secure engagement with a fastener element so as to facilitate application of high torque loads and rotary displacement of the fastener element.

Still another object of the present invention is to provide a drive socket with protuberances formed on the socket cavity surface in a knurled or cross-hatched pattern for biting into the surface of a fastener element when turning in either the clockwise or counterclockwise direction.

Yet another object of the present invention is to provide a drive socket adapted to apply torque turning loads to fastener elements of various geometric configurations utilized in the fastener art.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a drive socket having a novel cavity surface design is provided to assist in the installation and removal of fastener elements. The drive socket can be used in a variety of applications and is especially advantageous in removing fastener elements that are so tightly attached that a substantially adhesive-like bond must be overcome.

The drive socket has a substantially cylindrical body that facilitates its use in working environments where fastener elements may not be easily accessible, such as on a recessed surface. The body of the drive socket is provided with a bore at the proximal end to receive the stem of a drive element such as a ratchet or air wrench. Although the bore may be fabricated to any shape, it is generally square to accommodate standard square stems.

The cavity of the drive socket is broached into the body so as to be exposed to a first or distal end. The cavity receives a fastener element as the drive socket is positioned for operative use. The surface of the cavity is formed with a plurality of protuberances designed to firmly engage the fastener element for installation or removal.

Prior art drive sockets have a cavity surface that engages the fastener element with continuous, uninterrupted contact along the entire height or length of the planar surface of the element. The planar engagement of the confronting faces of the fastener element and socket cavity surface is generally sufficient to apply the necessary torque load when there is a firm but displaceable union to be established and released.

However, in situations where, for example, the fastening element is "frozen" and an adhesive-like union has formed, the engagement between planar faces of the socket cavity surface and the flat walls of the fastener element is inadequate for applying the torque turning loads necessary to generate rotary displacement and subsequent removal of the element. The inventive drive socket offers a solution by providing a cavity surface that has improved torque transmitting characteristics, More particularly, the protuberances each extend obliquely from all points on its periphery toward the central axis of the cavity. With this configuration, they are adapted to superficially penetrate the surface of and cooperatively grip the fastener element. The cavity surface pattern allows contact at intermittent, longitudinal points on the fastener element. The intermittent contact between the protuberances and the longitudinal surface of the fastener element advantageously assists the socket in gripping the element for applying the required torque load.

In particular, the applied force is concentrated through the protuberances to the points of contact with the fastener element. This concentration of force serves to seat the protuberances into the surface of the fastener element for the best gripping action. Once seated, the protuberances efficiently direct the applied torque load to the fastener element, thereby effectively allowing "frozen" fastener elements to be removed. This is advantageously done while positively resisting slipping across the corners of the fastening element and, accordingly, "stripping" of the fastening element is most effectively prevented.

The protuberances are disposed both longitudinally along and circumferentially around the cavity surface. Thus, the protuberances form a knurled or cross-hatched cavity surface. This advantageously allows the drive socket to bite into the surface of the fastener element to improve the torque transmission characteristics when turning the element in either the clockwise or counterclockwise direction. Accordingly, the inventive drive socket provides greater assistance than prior art designs in both tightening and, particularly, removing fastener elements that have formed an adhesive-like bond.

Further, the protuberances are uniformly spaced in order to provide even point contact for uniform torque transmission. The protuberances are disposed between grooves having oblique surfaces and extending longitudinally along and circumferentially around the cavity surface. The protuberances are generally pyramidally shaped with the wider base of each protuberance on the cavity surface. Each protuberance extends radially inwardly towards the central axis of the cavity.

The preferred embodiment includes a cavity surface wherein each protuberance is substantially a frustum. The frusto-pyramidal shape of the protuberances offers the optimal surface-to-surface contact between the fastener element and the cavity surface. It is contemplated, however, that the pyramidally shaped protuberance may extend to a pointed apex. Further, other geometric configurations may be used to define the protuberances; e.g. they may be conically shaped.

In the preferred embodiment, the protuberances are circumferentially spaced at angles of substantially 22.5° relative to the central axis of the cavity (i.e. sixteen protuberances are provided in each row about the circumference of the socket cavity). Accordingly, this provides 16-point contact with the fastener element that is received in the cavity. It can be appreciated, however, that variations in the circumferential disposition may be used.

In another aspect of the invention, the cavity is inwardly tapered from the distal end of the body. This further acts to facilitate not only receipt over the fastener element but also firm biting contact to particularly assist in its removal. Thus, the drive socket may be telescopingly extended over a fastener element until the tapered cavity grippingly engages the element. Once the element is firmly engaged, the socket can transmit the required torque load to the element to facilitate rotary displacement.

When in operative use, as for example in removing tightly attached lug nuts of an automobile wheel, the socket is telescopingly extended over the lug nut. The socket is forced onto the lug nut until the tapered cavity surface firmly engages the nut. This action allows the protuberances on the cavity surface to bite into the surface of the lug nut. Accordingly, when the turning load is applied to the lug nut, the torque is more efficiently transmitted to facilitate rotary displacement and removal of the lug nut.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Figure 1:
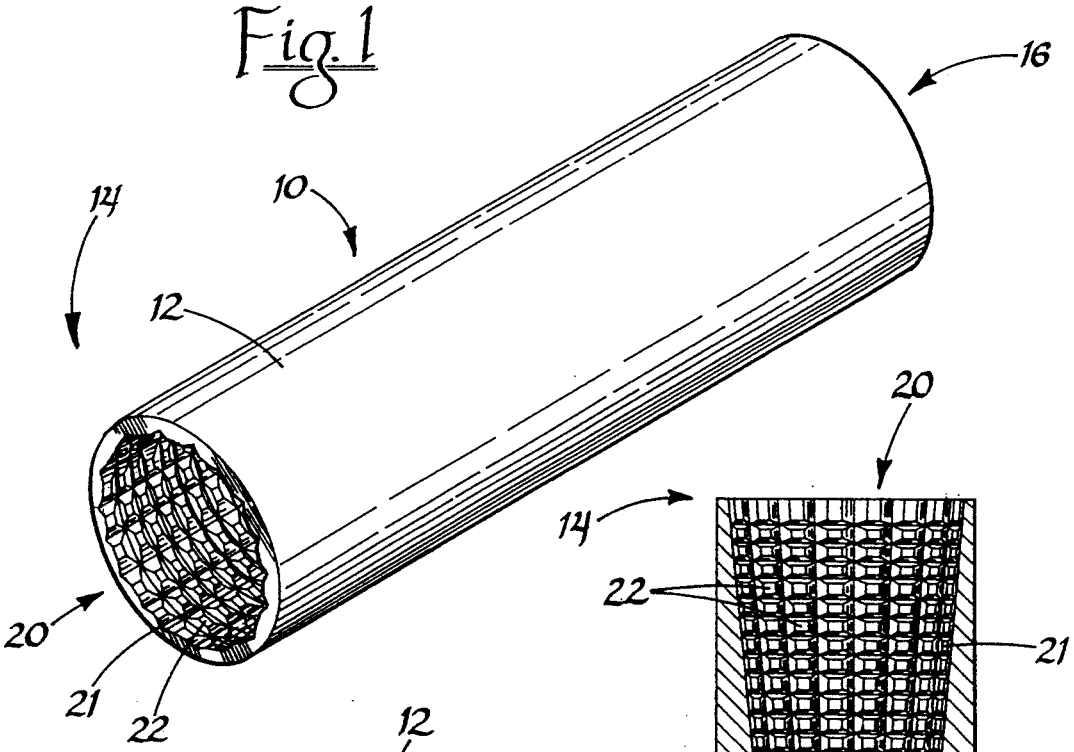
FIG. 1 is a perspective view of the drive socket of the present invention showing the distal end adapted to receive a fastener element.
Figure 2:
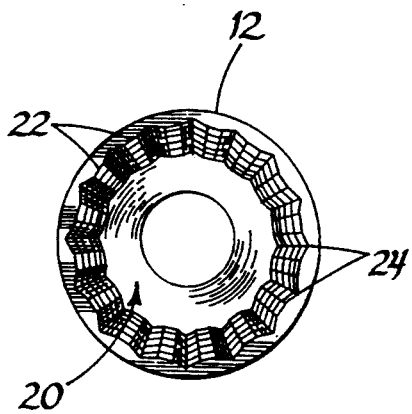
FIG. 2 is an end view of the drive socket of the present invention, looking into the cavity that receives and engages the fastener element.

Reference will now be made in detail to the present preferred embodiment of the invention, an example of which is illustrated in the accompanying drawing.

DETAILED DESCRIPTION OF THE INVENTION

A preferred embodiment of the drive socket 10 is provided according to the teachings of the present invention. As will become apparent by reviewing the description below, the drive socket 10 is adapted to impart torque loads on fastener elements to generate rotary displacement- The inventive drive socket 10 is particularly useful in turning and removing fastener elements that are so tightly attached that they are effectively stripped and hence, not removable with drive sockets of prior art design.

The drive socket 10 has a body 12 with a distal end 14 adapted to receive a fastener element. Although the body 12 may take on a variety of shapes, the preferred embodiment contemplates a substantially cylindrical configuration. Thus, the drive socket 10 is operable in common working environments. This is particularly important when the fastener elements are not easily accessible, such as when countersunk for aesthetic purposes. The drive socket body 12 is optimally sized so as to fit in a recessed or countersunk area while operatively receiving and engaging the fastener element.

The socket body 12 also has a proximal end 16 opposite the distal end 14. For most applications, it is desirable to manipulate the drive socket 10 with a drive instrument such as a ratchet or an air wrench. Accordingly, the preferred embodiment of the inventive socket 10 includes a bore 18 formed in the proximal end 16 for detachably receiving the stem of a drive instrument. The bore 18 may be milled to any shape to receive stems of any cooperative configuration. However, since most drive instruments have square stems, the bore 18 in the socket body 12 is preferably milled to have a cooperating square profile.

The inventive drive socket 10 is effective in applying rotary forces and, particularly, the relatively high torque loads required to tighten down and loosen frozen fastener elements. In fact, the present invention is generally capable of applying higher torque loads than prior art socket designs while also substantially avoiding slipping over the fastening element and the resulting stripping that renders the fastening element unserviceable.

In order to achieve this advantage, the proximal end 14 of the drive socket 10 includes therein a unique cavity 20 for receiving a fastener element such as a nut or bolt. The cavity 20 is broached with a surface 21 including a plurality of protuberances 22 each of which extends obliquely from all points on its periphery toward the central axis of the cavity 20. This allows the protuberances 22 to bear against and grippingly engage the surface of the fastener element. As is shown most clearly in FIG. 4, the protuberances 22 are disposed both longitudinally along and circumferentially around the cavity surface 21. Hence, the protuberances 22 are provided in a series of rows and columns.

As described in greater detail below, each protuberance 22 is shaped to provide a pair of oppositely disposed upper leading edges 23 adapted to engage a fastener element, whether that element is being turned in a clockwise or counterclockwise direction. Each leading edge 23 represents a point of contact through which the torque load is concentrated or focused upon the fastener element. This force quickly seats the protuberances 22 superficially into the surface of the fastener element so that substantially higher torque loads may be effectively applied to tighten or loosen a fastener element.

The protuberances 22 extend radially inwardly toward the central axis of the cavity 20 between longitudinal and circumferential grooves 24 and 26. Each of the grooves 24 and 26 are formed with oblique surfaces. Accordingly, the protuberances 22 form a knurled of cross-hatched pattern on the cavity surface 21. Thus contact is made by the cavity surface 21 at intermittent, longitudinal points on the fastener element surface.

The protuberances 22 are also uniformly spaced in both longitudinal and circumferential relation. This allows even, uniform engagement between the protuberances 22 in the drive socket 10 and the fastener element. The resulting balanced engagement eliminates one factor that promotes slipping of a socket over the corners of a fastening element in some prior art designs.

Figure 4:
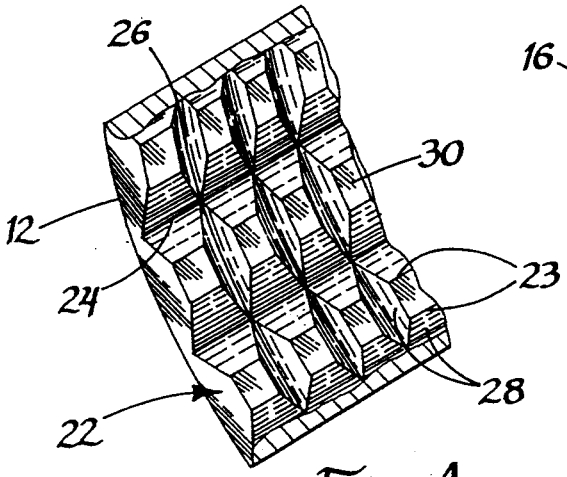
FIG. 4 is an enlarged cut away perspective view of the socket cavity, particularly showing the frusto-pyramidal configuration of the protuberances.

In the preferred embodiment of the invention, each individual protuberance 22 is pyramidally shaped. More specifically, as is shown in FIG. 4, each protuberance 22 has sides 28 that project in converging relation from a base between the grooves 24, 26 toward the central axis of the cavity 20 to a substantially flat apex 30. Thus, each protuberance 22 is substantially a frustum. The flat apex 30 includes the side edges 23 discussed above that engage and cut into the fastener element in the manner described above to provide the positive gripping action. Whether tightening or loosening a fastener element, each protuberance 22 presents a leading edge 23 to make engagement. Of course, it can be appreciated, however, that the protuberances 22 may take on other configurations, such as rising to a pointed apex or being conically shaped if this were desired for a particular application.

Figure 3:
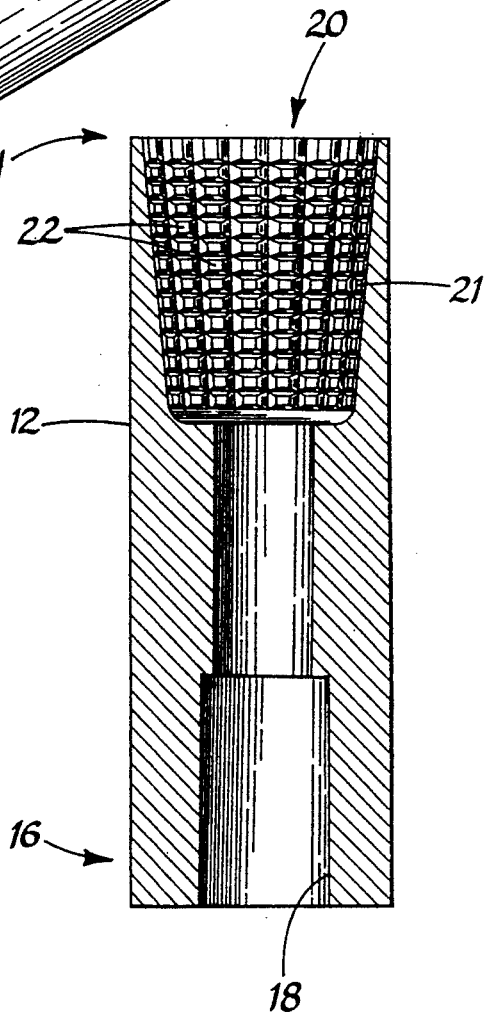
FIG. 3 is a cross-sectional view of the drive socket of the present invention, particularly showing the inwardly directed taper of the socket cavity.

To assist in the gripping engagement between the cavity surface 21 of the drive socket 10 and the fastener element, the cavity 20 is inwardly tapered from the distal end 14 as shown in FIG. 3. Accordingly, the cavity 20 may be telescopingly extended over a fastener element until there is complete circumferential engagement therebetween. Of course, it can be visualized that substantially similar drive sockets 10 but having varied cavity sizes may be manufactured and used as a set to allow operation on fastener elements of a variety of sizes.

Preferably, the protuberances 22 are circumferentially spaced at angles of substantially 22.5° relative to the central axis of the cavity 20. Accordingly, each row of protuberances 22 around the 360° circumference of the socket 10 includes sixteen members. This 16-point contact is provided between the protuberances 22 in each row and the outer periphery of the fastener element.

The row and column arrangement of the protuberances 22 thus offers a greater number of contact points than that of standard, state of the art drive sockets incorporating ribs or splines extending longitudinally and continuously along the cavity surface that drive against the flats of a fastener element. These additional contact points enhance the capability of the present socket design to operatively mate and engage with fastener elements of various geometric configurations. Hence, the present socket 10 provides improved versatility not seen in the prior art.

Further, it should also be recognized that the present drive socket 10 is not as sensitive to the shape of the fastener element, including both the number of flat sides presented and fluctuations in size due to machining variables, as its operation involves the superficial penetration of the fastener element surface rather than exact registry of confronting faces. The protuberance pattern offers a substantial and efficient number of contact points to grip the fastener element and provide the required torque transmission. It can be appreciated, however, that the protuberances 22 may be circumferentially spaced at greater or lesser angles to provide a different number of contact points if desired.

As mentioned above, the novel protuberance pattern and cavity taper advantageously facilitate the torque transmission function of the inventive drive socket 10. In addition, the drive socket 10 is preferably made of a hard metal such as cold-rolled steel to assist in the ability of the protuberances 22 to bite into and grip the fastener element. The combination of the drive socket characteristics are particularly beneficial in allowing the socket 10 to operate on fastener elements that are frozen and have formed an adhesive-like bond over time.

In summary, numerous benefits have been described which result from employing the concepts of the present invention. The drive socket 10 has a plurality of protuberances 22 formed in substantially perpendicularly arranged rows and columns on the cavity 20 that receives and engages a fastener element whether that element is being turned in a clockwise or counterclockwise direction- The protuberances 22 are preferably frusto-pyramidally shaped to superficially bite into the surface of the fastener element, whether that element is being turned in a clockwise or counterclockwise direction. Accordingly, the protuberances 22 on the tapered cavity surface 21 provide a firm, biting grip on the fastener element to transmit the appropriate torque load to generate rotary displacement. The inventive drive socket 10 operates efficiently to install and remove fastener elements. The drive socket 10 is, however, particularly useful in displacing and removing fastener elements that have become frozen in position such as often occurs over time.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A drive socket for imparting torque loads to a fastener element, comprising:

a body;

a cavity within said body having an inner curvilinear working surface and opening to a distal end of said body for receiving said fastener element; and a plurality of protuberances spaced circumferentially around and longitudinally along said entire curvilinear surface, each protuberance extending obliquely from all points on its periphery toward the central axis of said cavity, for engaging the circumference of said fastener element, said protuberances defining grooves extending longitudinally along and circumferentially around said curvilinear working surface, said longitudinal and circumferential grooves forming surfaces of adjacent protuberances that extend obliquely inwardly in opposing directions, with each successive circumferential groove having a reduced radius in a direction toward a proximal end of said body, whereby said socket securely grips said fastener element to facilitate rotary displacement.

2. The drive socket of claim 1, wherein said protuberances are disposed in uniform relation both longitudinally along and circumferentially around said surface.

3. The drive socket as in claim 1, wherein each of said protuberances is substantially pyramidally shaped.

4. The drive socket as in claim 1, wherein each of said protuberances is substantially a frustum.

5. The drive socket as in claim 4, where each of protuberances is substantially frusto-pyramidally

6. The drive socket as claim 1, wherein adjacent protuberances and adjacent longitudinal grooves are circumferentially spaced on said surface at angles of substantially 22.5° relative to the central axis of said cavity.

7. The drive socket as in claim 1, wherein said cavity is inwardly tapered from said distal end.

8. The drive socket as in claim 2, wherein said body is substantially cylindrical.

9. A drive socket for imparting torque loads to a fastener element, comprising:

a body;

a cavity within said body having an inner curvilinear working surface and opening to a distal end of said body for receiving said fastener element; and a plurality of protuberances on said curvilinear working surface for engaging intermittent longitudinal points on the circumference of said fastener element, said protuberances defining grooves extending longitudinally along and circumferential around said curvilinear working surface, said longitudinal and circumferential grooves forming surfaces of adjacent protuberances that extend obliquely inwardly in opposing directions with each successive circumferential groove having a reduced radius in a direction toward a proximal end of said body, p1 whereby said socket securely grips said fastener element to facilitate rotary displacement.

10. The drive socket as in claim 9, wherein said protuberances are disposed in uniform relation both longitudinally along and circumferentially around said surface.

11. The drive socket as in claim 9, wherein each of said protuberances is substantially pyramidally shaped.

12. The drive socket as in claim 9, wherein each of said protuberances is substantially a frustum.

13. The drive socket as in claim 12, wherein each of said protuberances is substantially frusto-pyramidally shaped.

14. The drive socket as in claim 9, wherein adjacent protuberances and adjacent longitudinal grooves are circumferentially spaced on said surface at angles of substantially 22.5° relative to the central axis of said cavity.

15. The drive socket as in claim 9, wherein said cavity is inwardly tapered from said distal end.

16. The drive socket as in claim 9, wherein said body is substantially cylindrical.

* * * * *